US009936813B2

(12) United States Patent
Kraeutle et al.

(10) Patent No.: US 9,936,813 B2
(45) Date of Patent: Apr. 10, 2018

(54) BED FRAME HAVING FLEXIBLE SLATS WHICH ARE ADJUSTABLE IN A HORIZONTAL PLANE

(71) Applicant: DOC AG, St. Gallen (CH)

(72) Inventors: Martin Kraeutle, Hechingen (DE); Stefan Wiesenauer, Ludwigsburg (DE)

(73) Assignee: DOC AG, St. Gallen (CH)

( * ) Notice: Subject to any disclaimer, the term of this patent is extended or adjusted under 35 U.S.C. 154(b) by 96 days.

(21) Appl. No.: 14/806,773

(22) Filed: Jul. 23, 2015

(65) Prior Publication Data

US 2016/0166075 A1 Jun. 16, 2016

(30) Foreign Application Priority Data

Dec. 10, 2014 (DE) ..... 10 2014 018 363

(51) Int. Cl.
*A47C 23/06* (2006.01)
*A47C 19/02* (2006.01)

(52) U.S. Cl.
CPC ..... *A47C 23/061* (2013.01); *A47C 19/021* (2013.01); *A47C 19/025* (2013.01); *A47C 23/063* (2013.01); *A47C 23/067* (2013.01); *A47C 23/062* (2013.01); *A47C 23/064* (2013.01)

(58) Field of Classification Search
CPC ..... A47C 23/06; A47C 23/061; A47C 23/062; A47C 23/063; A47C 23/064; A47C 23/067; A47C 23/068; A47C 19/02; A47C 19/021; A47C 19/025; A47C 19/027
USPC ..... 5/238, 241, 236.1
See application file for complete search history.

(56) References Cited

U.S. PATENT DOCUMENTS

| | | | | |
|---|---|---|---|---|
| 9,578,974 | B2 * | 2/2017 | Kraeutle | A47C 23/067 |
| 2016/0166075 | A1 * | 6/2016 | Kraeutle | A47C 19/025 5/238 |
| 2016/0235208 | A1 * | 8/2016 | Kraeutle | A47C 23/067 |

FOREIGN PATENT DOCUMENTS

| | | |
|---|---|---|
| DE | 8429877.4 | 2/1985 |
| DE | 10111585 | 7/2002 |
| DE | 202006008526 U1 | 8/2006 |
| DE | 202006019414 U1 | 2/2007 |
| DE | 202008010096 U1 | 10/2008 |
| EP | 0141260 | 5/1985 |
| EP | 1066778 | 1/2001 |

OTHER PUBLICATIONS

European Examination Report/Search Report from EP15001826.5, dated Apr. 12, 2016.

* cited by examiner

*Primary Examiner* — Robert G Santos
(74) *Attorney, Agent, or Firm* — Browdy and Neimark, PLLC

(57) ABSTRACT

A bed frame having flexible slats which are adjustable in a horizontal plane and having at least one bearing element for supporting one end of at least one flexible slat on a longitudinal beam of the bed frame is provided. The bearing element is movable over an arbitrary displacement path along the longitudinal beam. The bearing element includes a housing which accommodates the respective end of the flexible slat and in which at least one spring-loaded detent device, which is actuatable by hand, is situated and which engages with associated receiving profiles in the longitudinal direction of the longitudinal beam and is lockable at that location.

18 Claims, 15 Drawing Sheets

2 (3)

2 (3)

20
26
27
34
25
28
30
31
37
29
63
10
9
22
23
32
39
A 44
45
46
47
9

44
45
47
9

44
45
46
47
9

BED FRAME HAVING FLEXIBLE SLATS WHICH ARE ADJUSTABLE IN A HORIZONTAL PLANE

FIELD

The invention relates to a bed frame having flexible slats which are adjustable in a horizontal plane, and a fitting suitable for this purpose for a lying surface formed from the bed frame.

BACKGROUND

According to the invention, the term "bed frame" is understood to mean any arrangement of a sitting or lying surface whose support surface is formed from flexible slats separated at a distance from one another. Accordingly, this also includes slatted frames having flexible slats which are elastically supported in the vertical direction, or also solid frames in which the flexible slats are inelastically situated.

For lying surfaces for beds, sofas, and seating furniture, there is a need for moving the flexible slats, which support the seat cushion or the mattress, in the horizontal direction.

Such a lying surface is already known, and relates to flexible slats which are adjustably fastened to a slatted frame so as to be displaceable in the horizontal direction over a short displacement range.

Accordingly, in a manner known per se, each flexible slat is supported on the end-face side in a bearing element which is fixedly and immovably mounted on the longitudinal beam of a bed frame or a slatted frame.

According to the prior art, it is known only to carry out a horizontal adjustment of the flexible slat in the bearing element itself; however, it is not known to move and fix the bearing element in the longitudinal direction with respect to the longitudinal beam.

Thus, in the known prior art, this results in the disadvantage that an adjustment path of the flexible slats of only around a range of 2 cm is provided. Therefore, it is possible to only slightly adjust the mutual distances between the flexible slats in a slatted frame or a bed frame.

SUMMARY

The object of the invention, therefore, is to refine a horizontal adjustment and fixing of flexible slats in a slatted frame and/or bed frame of the type stated at the outset in such a way that an adjustment of the horizontal spacing between the flexible slats can take place in a significantly larger displacement range.

To achieve the stated object a bed frame is provided having flexible slats which are adjustable in a horizontal plane and having at least one bearing element for supporting one end of at least one flexible slat on a longitudinal beam of the bed frame, wherein the bearing element is movable over an arbitrary displacement path along the longitudinal beam, in that the bearing element comprises essentially a housing which accommodates the respective end of the flexible slat and in which at least one spring-loaded detent device, which is actuatable by hand, is situated and which engages with associated receiving profiles in the longitudinal direction of the longitudinal beam and is lockable at that location.

An essential feature of the invention is that the particular end face of the bearing element itself, accommodating the flexible slat, is movable and fixable along the longitudinal beam of the bed frame over an arbitrary displacement path in the horizontal direction.

The stated technical teaching provides the advantage that each flexible slat now has a design which is individually adjustable and fixable in relation to the adjacent flexible slat over any size of adjustment path along the longitudinal axis of the longitudinal beam of the bed frame, because the bearing element itself for accommodating the flexible slat forms the adjusting element.

It is thus provided according to the invention that all bearing elements which support the flexible slats are movably adjustable and fixable in the direction of the longitudinal beams of the bed frame and/or slatted frame over an arbitrary displacement path.

According to the present invention, a bearing element is understood to mean a complex bearing body having spring elements which may have an arbitrary design.

Spring elements of this type may be elastomer springs or elements suspended in some other way, which are able to elastically support the particular end face of the flexible slat in the vertical direction.

According to one refinement of the invention, however, in another embodiment it may also be provided that such spring elements are dispensed with entirely.

Furthermore, in another embodiment of the invention it may be provided that in each case an additional height adjustment device may also be situated on the bearing elements for accommodating the end faces of the flexible slats. In this case, it is provided that not only are the end faces of the flexible slats displaceable by moving the bearing elements in the horizontal direction, but also height adjustment devices are additionally present in the bearing element, so that also the height of the flexible slats is adjustable and fixable via the bearing element.

However, the invention is not dependent on such a height adjustment device, which may also be dispensed with.

It is important only that the flexible slats themselves have a design which is adjustable and fixable in an arbitrary adjustment path in the direction of the longitudinal beam of the particular slatted frame and/or bed frame, so that, for the first time, there is now the option for defining different lying areas on the lying surface by means of flexible slats having different spacings from one another.

In this way, an arrangement of such flexible slats in groups, for example, may be provided by freely moving flexible slats, in particular at the locations of the lying surface where maximum support of the body of a user lying thereon is necessary. For example, it is possible to push the flexible slats together in such a way that in the lumbar area there is a very high density of flexible slats at that location, while around the lumbar area (above and below), it is not necessary to arrange any flexible slats, or a different spacing is provided.

The division of the lying surface using differently grouped flexible slats which are freely movable and fixable along the longitudinal beam of the lying surface has not been known heretofore. For this reason, the invention provides a number of options for how such a displacement of flexible slats in the area of the lying surface can take place.

The term "lying surface" is understood to mean all lying surfaces of upholstered furniture, seating furniture, or bed furniture which are able to bear a cushion support. Accordingly, the invention is not dependent on the flexible slats being part of a slatted frame. The flexible slats with their bearing elements according to the invention may also engage directly on the longitudinal beams of a bed frame, in which case a slatted frame would be dispensed with.

In a preferred refinement of the present invention, it is provided that the bearing elements according to the invention for holding the flexible slats, which are adjustable and fixable in the longitudinal direction of the longitudinal beams, are lockable into an undercut groove in the longitudinal beam in the transverse direction with respect to the longitudinal axis, so that it is not necessary to successively insert these bearing elements in the direction of the longitudinal groove in the longitudinal beam; instead, they may clipped into the longitudinal groove in the direction perpendicular to the longitudinal groove.

Thus, there is the advantage that even with a fully assembled slatted frame or a bed frame, additional bearing elements which are suitable for accommodating additional flexible slats may still be subsequently clipped into the longitudinal groove in the longitudinal beam.

The flexible slat density, i.e., the number of flexible slats in the slatted frame or in the bed frame, may thus be easily increased or decreased. Thus, the bearing capacity of the slatted frame or of the bed frame may be arbitrarily changed, even subsequently for a fully assembled bed frame or slatted frame, by adding or taking away flexible slats and associated bearing elements.

In one preferred embodiment of the invention, it is provided that the bearing element according to the invention is made up essentially of a housing in which two locking bars facing in opposite directions are present which are in spring-loaded engagement with an associated locking rail, the locking rail being fastened in a longitudinal groove on the inner side of the longitudinal beam of the slatted frame.

For the sake of simplicity of description, in the following description, and accordingly also in the following description of the drawings, a slatted frame fitted with flexible slats is assumed, although the invention is not limited thereto.

As stated above, the slatted frame may also be dispensed with entirely, and the bearing elements according to the invention could be situated directly in the longitudinal beams of a bed frame. Solely for the sake of simplicity of description, a slatted frame fitted with flexible slats is assumed, although the invention is not limited thereto.

Accordingly, in one preferred embodiment of the invention it is provided that the locking bars necessary for longitudinal adjustment and fixing are in spring-loaded engagement with associated receiving profiles in the longitudinal direction of the longitudinal beam. In a first embodiment of the invention, it is provided that this receiving profile is designed as a locking rail which extends in the longitudinal direction over the entire length of the longitudinal beam and which has associated toothing.

In another embodiment of the invention, it may be provided that the locking rail is replaced by a perforated rail, and in a third embodiment of the invention it may be provided that the locking rail is not situated in an undercut groove in the hollow profile of the longitudinal beam, but instead is designed as an insertion rail.

In another embodiment, it may also be provided that the longitudinal beam is made of a deformable metal profile, in particular an aluminum profile, and that such a locking rail in the form of embossings is situated in the longitudinal direction of the longitudinal beam.

Instead of attaching toothing, perforated profiles may also be used which are either directly introduced into a profile of a longitudinal beam or subsequently inserted as an insertion rail.

In another embodiment, it may be provided that instead of two oppositely situated, spring-loaded locking bars, a locking comb is provided which bears a plurality of detent elements which may be brought into selective engagement with the counter profile in the longitudinal direction of the longitudinal beam.

Instead of a spring-loaded engagement of the above-described detent elements, detent devices may be used which operate, for example, according to the screw principle, the clamping principle, or other back-and-forth adjustment mechanisms.

In this regard, it may be provided that wedge profiles are used to achieve, instead of a toothing engagement, a clamping engagement between the bearing element and the associated profile on the beam side of the slatted frame.

It may thus be stated that instead of a locking engagement achieved by spring loading or mechanically by tensioning elements, a clamping engagement is also encompassed according to the invention.

The subject matter of the present invention results not only from the subject matter of the individual claims, but also from the combination of the individual claims with one another.

All information and features disclosed in the documents, including the abstract, in particular the spatial configuration illustrated in the drawings, are claimed as essential to the invention, provided that alone or in combination they are novel with respect to the prior art.

BRIEF DESCRIPTION OF THE DRAWINGS

The invention is explained in greater detail below with reference to drawings which illustrate multiple design approaches. Further features and advantages of the invention which are essential to the invention result from the drawings and their description.

The drawings show the following:

FIGS. 18 and 19: show a further embodiment of the design of the longitudinal beam;

DETAILED DESCRIPTION

Figure 1:
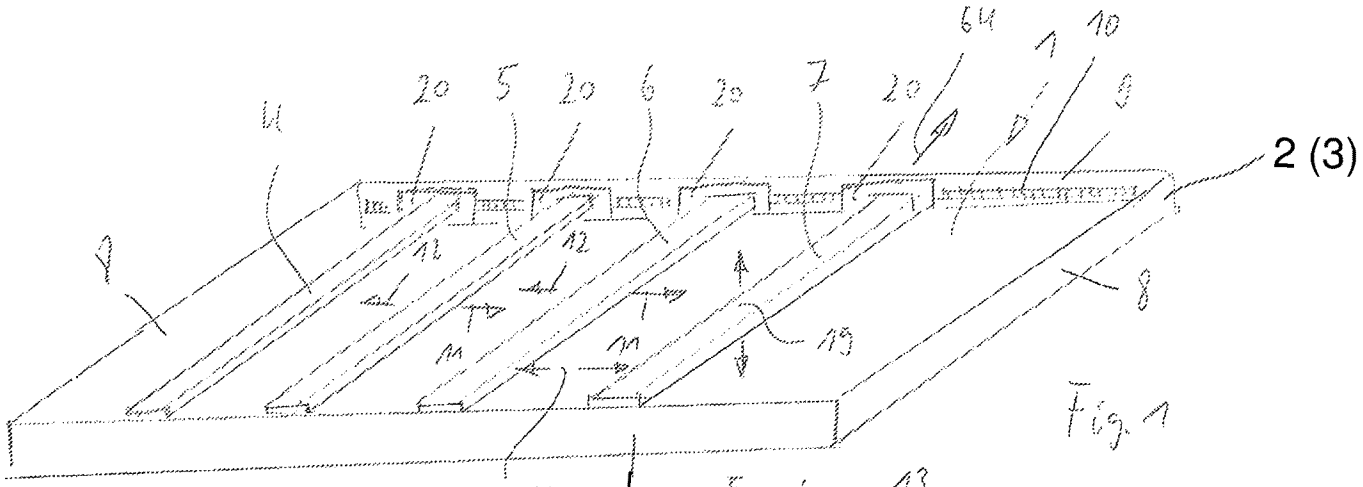
FIG. 1: schematically shows a perspective illustration of a lying surface in the design as a bed frame or slatted frame.
Figure 2:
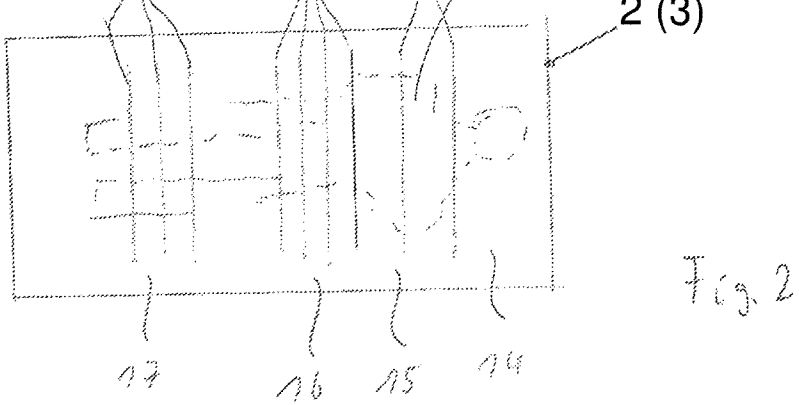
FIG. 2: schematically shows the top view of FIG. 1.

FIGS. 1 and 2 schematically illustrate in a general manner a lying surface 1 which is designed either as a bed frame 2 or as a slatted frame 3; in the latter case, the slatted frame 3 would be insertable into a bed frame 2, not illustrated in greater detail.

In the exemplary embodiment shown, it is assumed that this is a slatted frame 3, which is insertable into a bed frame 2, not illustrated in greater detail.

It is apparent here that a number of flexible slats 4-7 are inserted into the slatted frame 3 with arbitrary spacings 18, and that the horizontal spacings between the flexible slats 4-7 in the arrow directions 11, 12 are arbitrarily adjustable and fixable relative to one another in an arbitrary range.

The slatted frame 3, in a manner known per se, is made up of two mutually parallel transverse beams 8 which are connected to one another by two mutually parallel longitudinal beams 9. The slatted frame may be made of any given material, for example a metal profile, a wood profile, a plastic profile, or the like.

It is important that the respective flexible slats 4-7 at their end faces are accommodated in bearing elements 20, and that these bearing elements 20 are movable and fixable in an associated longitudinal groove at the inner side of the longitudinal beams 9 in the arrow directions 11, 12.

As the first exemplary embodiment, FIG. 1 shows that the longitudinal groove at the inner side of the longitudinal beam 9 may be designed as a locking rail 10 which has very fine notch divisions, which may be in the range of 1 to 3 mm, for example. This means that each flexible slat is adjustable and fixable in the range of 1 to 3 mm in the arrow directions 11, 12.

Equal displacement distances are provided on the left side of the longitudinal beam 9 and on the oppositely situated side of the longitudinal beam 9; thus, a scale is applied on the top side, for example, of each longitudinal beam 9, so that each bearing element 20 on each side may be set to the same displacement position on the respective longitudinal beam 9.

This is a scaling which as a scale is situated once on the bearing element, and which may be brought into a certain opposite position with respect to an associated scaling on the top side of the longitudinal beam 9.

FIG. 1 shows, as a further exemplary embodiment, that the invention may also provide a height adjustment 19 of the flexible slats 4-7; this height adjustment device will be described later as a type of height adjustment plate 28.

As already stated in the general description section, this height adjustment 19 may also be dispensed with entirely, with the horizontal adjustment in the arrow directions 11, 12 remaining.

Another important feature of the invention is that the bearing elements may be clipped into an associated retaining groove in the area of the longitudinal beam 9 in the arrow directions 64, and at any time, even with a slatted frame 3 which is fully fitted with flexible slats, additional bearing elements 20, each facing the arrow directions 64, may be clipped into the longitudinal groove in the area of the longitudinal beam and fitted with additional flexible slats.

In this way, the number of flexible slats for each lying surface 1 may be established in an arbitrary manner.

FIG. 2 shows, in only a rough schematic manner, that a person 13 may provide a different density and a different spacing of flexible slats at the desired body support points.

It is schematically illustrated that only a small number of flexible slats is present in the head area 14, for example, while a smaller number of flexible slats 6 is provided in the shoulder area 15 and a larger number of flexible slats 5 is provided in the lumbar area 16 with a fairly small spacing, whereas in the foot area 17 a smaller number of flexible slats 4 with a fairly large spacing is provided.

The number of flexible slats 4-7 as well as their mutual spacing may thus be configured so that they are freely adjustable on the lying surface 1.

Figures 3, 4, 5:
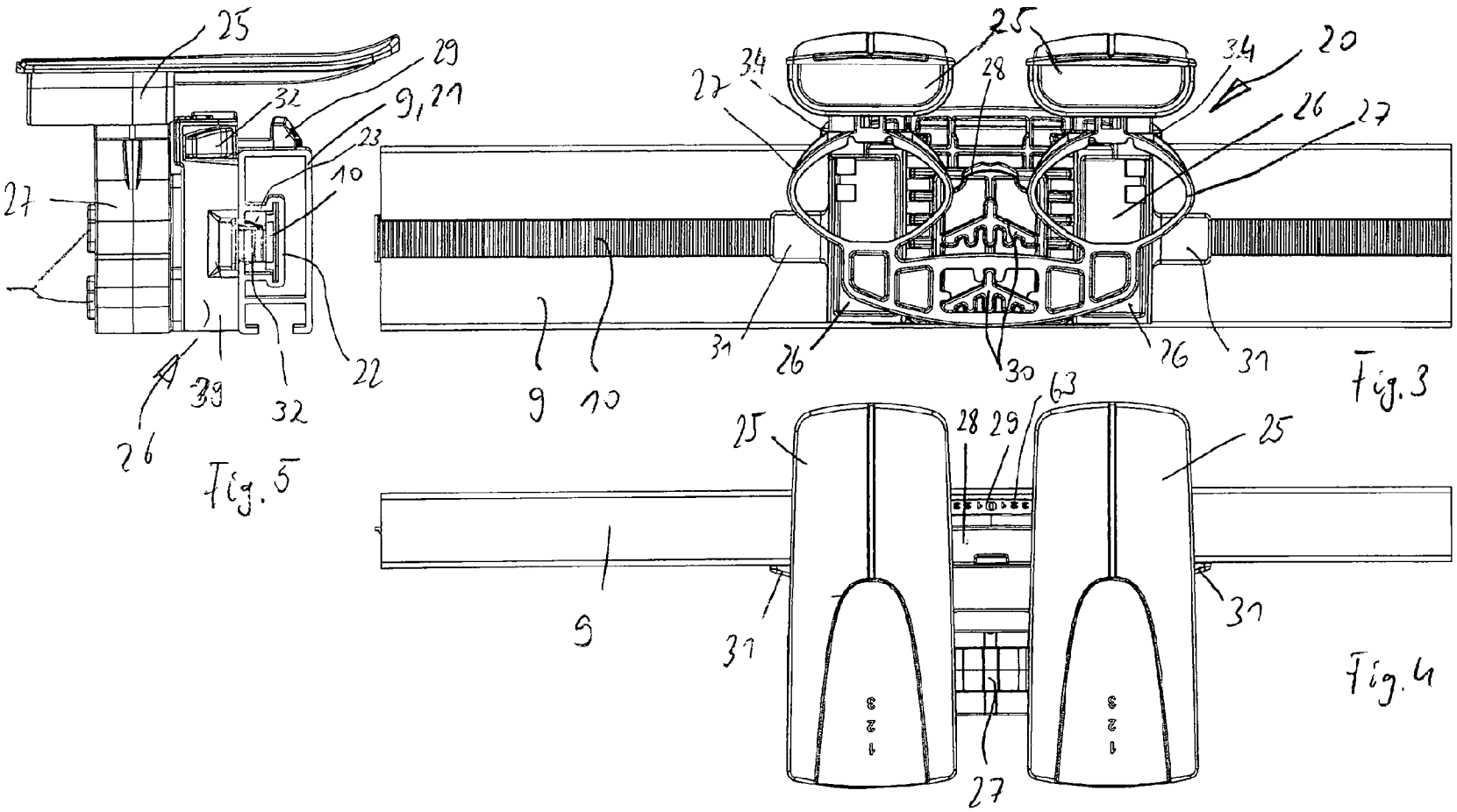
FIG. 3: shows the front view of a bearing element.
FIG. 4: shows the top view of the bearing element according to FIG. 3.
FIG. 5: shows the side view of the bearing element according to FIGS. 3 and 4.
Figure 6:
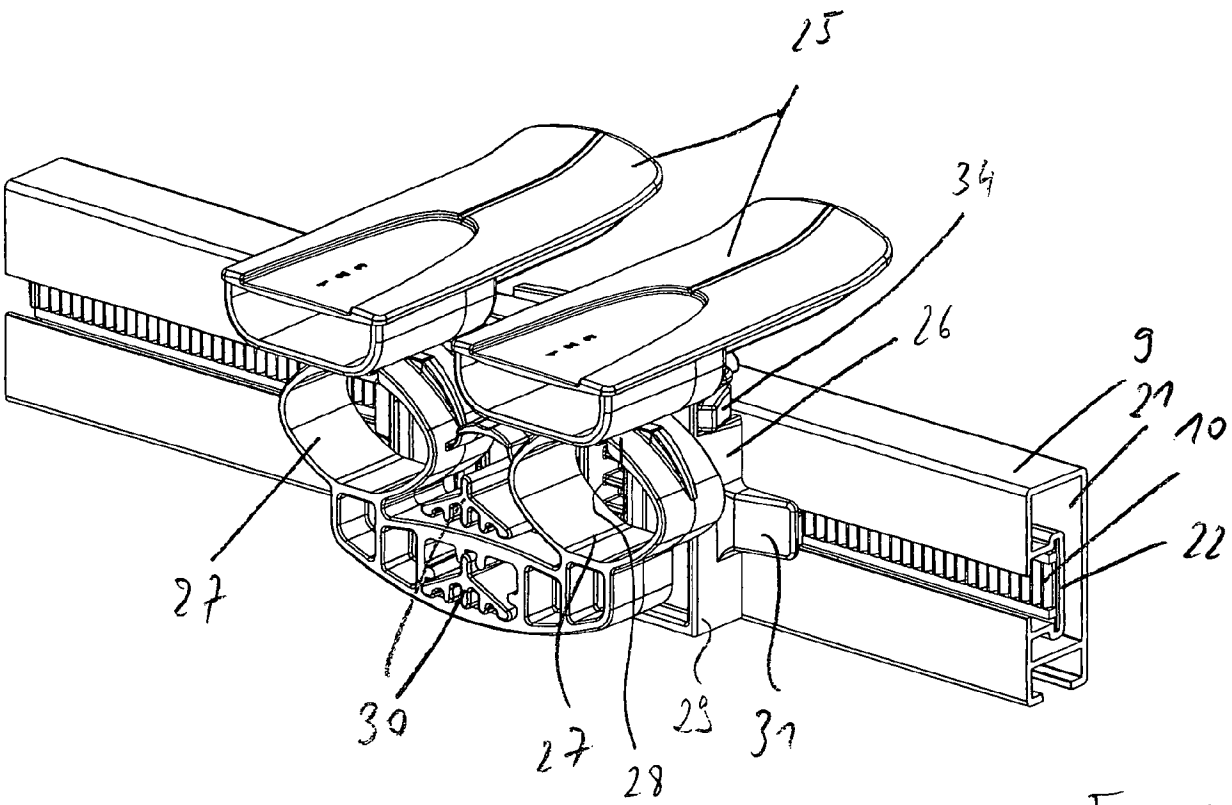
FIG. 6: shows a perspective view of the bearing element according to FIGS. 3 to 5.

In a first preferred exemplary embodiment, the longitudinal beam 9 of the slatted frame 3 is made of a hollow aluminum profile 21 which on its inner side has an undercut receiving profile 22 into which the locking rail 10 is inserted (FIG. 5).

The bearing element 26 is preferably made of a plastic housing 39 which has a hollow profile and which has spacers 31 that laterally protrude beyond the housing side walls, behind which spacers the associated locking bars 32 (not visible in FIG. 3), which are provided in engagement with the locking rail 10 on the longitudinal beam side, are situated.

FIGS. 3 to 5 also show that according to the invention, this housing 39 may be clipped into the undercut receiving profile 22 of the longitudinal beam 9, where it is held by detent hooks 23 which engage behind the undercuts of the receiving profile and thus ensure longitudinal displacement in the arrow directions 11 and 12, and only engagement in the arrow direction 64 (see FIG. 1), but not repeated disengagement in the direction opposite the arrow direction 64.

Each bearing element 20 may thus be clipped into the receiving profile 22 in the area of the longitudinal beam 9 in the arrow direction 64, but then can be removed from the receiving profile 22 only in the arrow direction 11 or 12.

The illustrations in FIGS. 3 to 5 also show that the bearing element 20 also includes a height adjustment plate 28, which allows a height adjustment of the spring elements 25 in relation to the bearing element 20 in the arrow directions 19.

Each spring element 25 is made up of two spaced-apart spring bodies having identical designs, which at the bottom are integrally molded onto a plate via curved spring bodies 27, the plate forming receiving openings for two holding pins 30 situated one on top of the other in parallel.

The holding pins 30 are integrally molded onto a height adjustment plate 28, which may be inserted behind the locking plate 26 for the bearing element 20 in the manner of a vertically oriented insertion guide.

The height adjustment plate 28 is height-adjustably moved on a locking part 29 on the locking plate 26 of the bearing element 20 and fixed to the locking part 20.

As already described, the height adjustment in the arrow directions 19 for the flexible slats is not necessary for the invention, but may be additionally provided.

Figures 7, 8:
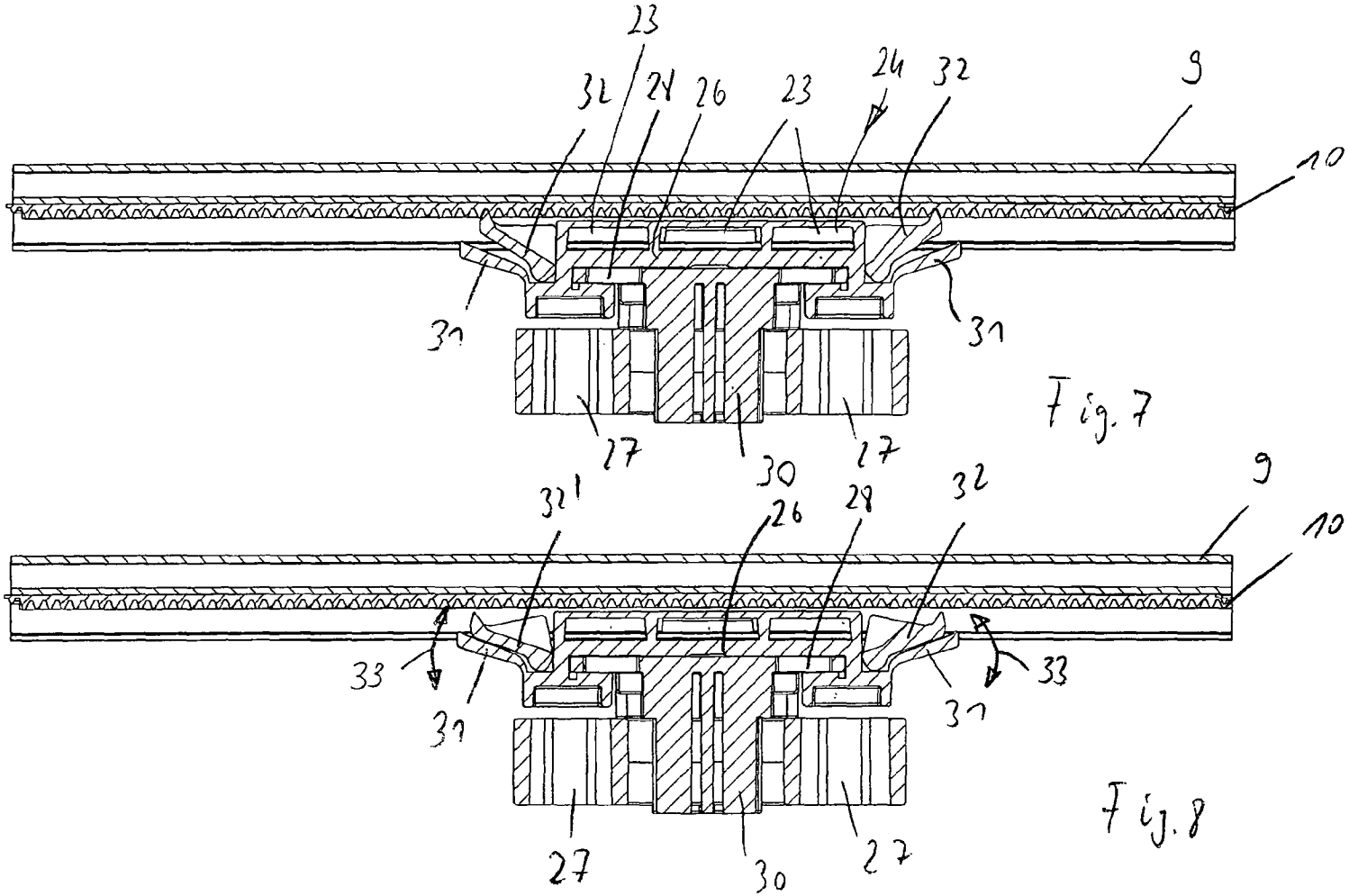
FIGS. 7 and 8: show a section through the bearing element in the locked and the unlocked states.
Figure 3:
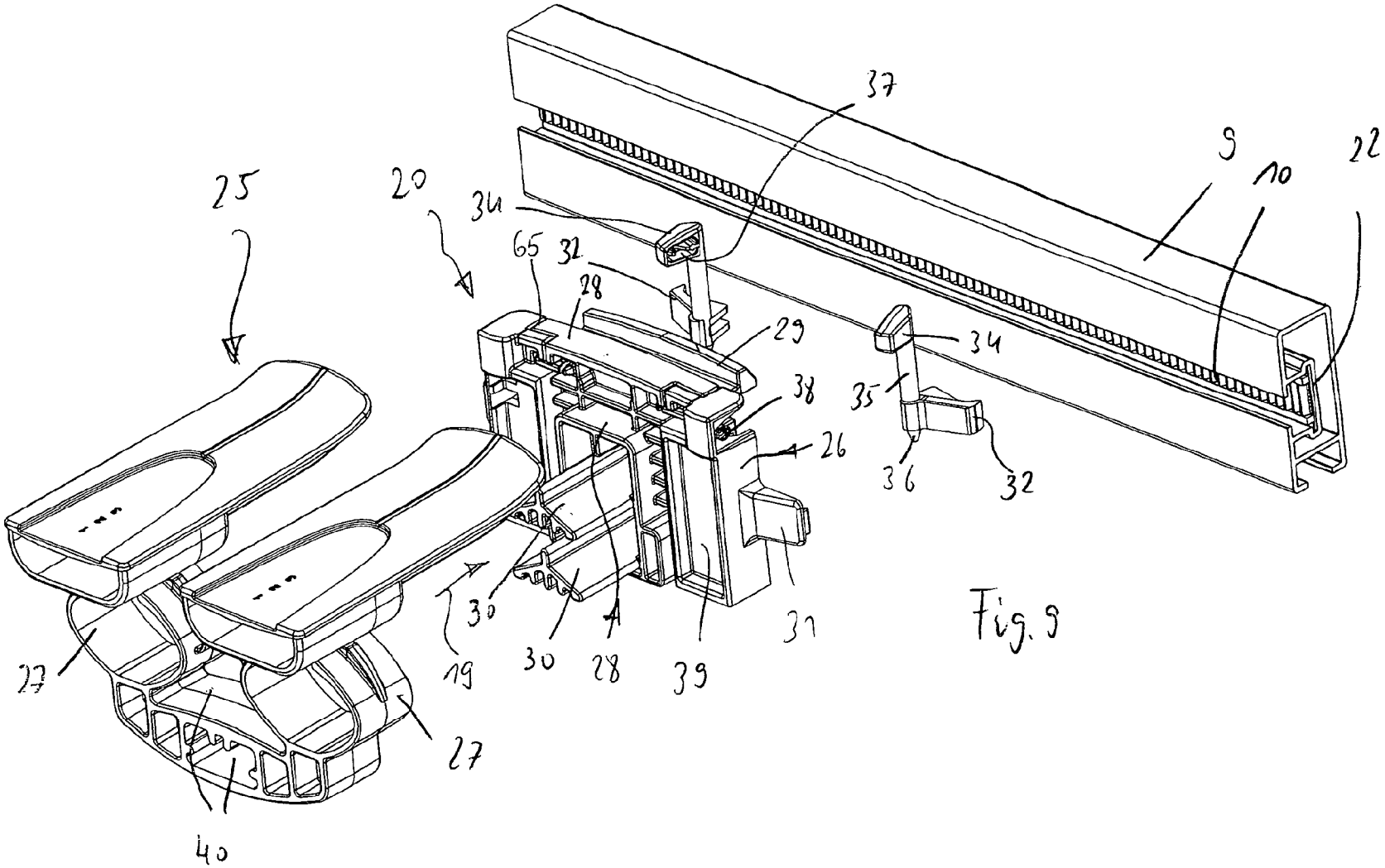

FIGS. 7 and 8 show the clip lock 24 of the bearing element 23, so that locking of the bearing element 20 into the undercut receiving profile 22 in the arrow direction 64 is possible.

This clip lock 24 is formed by multiple spaced-apart detent hooks 23, having an elastic design, which engage with associated undercuts of the receiving profile 22, as illustrated in FIG. 5.

FIGS. 7 and 8 also show that the locking plate 26 is part of a plastic housing 39 which defines the bearing element 20.

In addition, FIGS. 7 and 8 show the two mutually facing locking bars 32, which are held in spring-loaded engagement with the associated toothing of the locking rail 10.

Figure 9A:
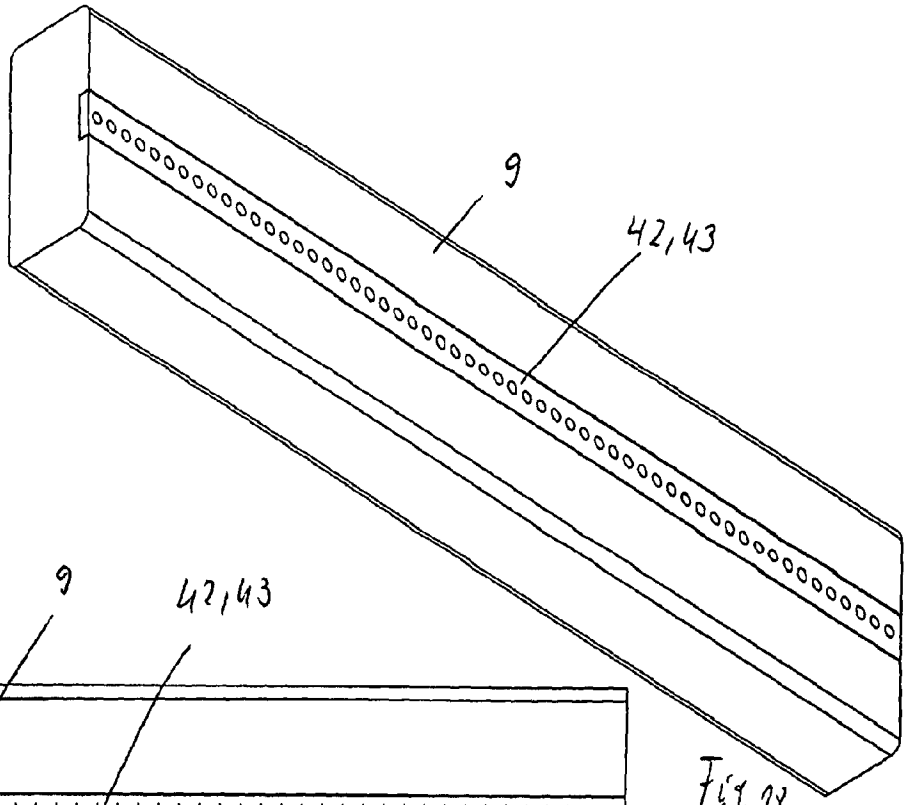
FIG. 9: shows an exploded illustration of the bearing element according to the preceding drawings.
Figure 9B:
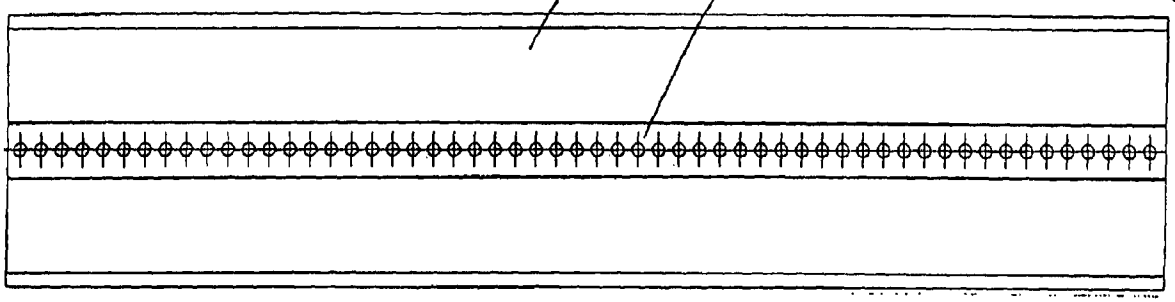

Disengagement takes place by actuating a handle 34 illustrated in FIG. 9.

Thus, the fingers of a hand must activate the one handle 34 as well as the other handle in order to bring both locking bars 32 out of the spring-loaded engagement with the locking rail 10.

The mutually directed locking of the locking bars 32 serves to prevent the bearing element 20 from being inadvertently moved in the arrow direction 10 or 11 in the locked state.

However, if only one locking bar 32 is actuated by activating a handle 34, the bearing element 20 according to FIG. 9 can be moved in one direction but not in the other direction.

The mutually facing spacers 31 are used to limit the stop of adjacently situated bearing elements 20. When adjacently situated bearing elements 20 are pushed close together, their spacers 31 contact one another, thus forming a displacement limitation.

FIG. 9 shows an exploded illustration of the design of the bearing element 20 according to the invention, the locking part 29 being used for the height adjustment, so that the height of the height adjustment plate 28 in the insertion guide 65 is adjustable and fixable in the area of the bearing element 20.

It is also apparent from FIG. 9 that the two locking bars 32 have identical designs, and each locking bar 32 is connected to a shaft 35 in a rotationally fixed manner, the handle 34 being fastened in a rotationally fixed manner to the top free end of the shaft.

The shaft 35 at the bottom side bears a bearing journal 36, and the entire element which includes the locking bar 32, the handle 34, and the shaft 35 is inserted into a cavity in the housing 39 of the bearing element 20, and a compression spring 38 situated in the housing engages in a receptacle 37 at the rear side of the handle 34 and pretensions the handle in a spring-loaded manner, so that the locking bar 32, which is thus connected in a rotationally fixed manner, comes into spring-loaded engagement with the toothing of the locking rail 10, and remains there as long as the handle 34 is not activated.

The pivoting of the shaft 35 thus takes place in the arrow direction 33.

FIG. 9 also shows that the entire spring element 25 may be attached to the holding pin 30 of the bearing element 20 in two different attachable height adjustment positions (height adjustment device 19).

Either both holding pins 30 engage in the superposed receiving spaces 40 on the spring element 25, or the spring element is set one step higher, so that only the top holding pin 30, for example, still engages in the bottom receiving space 40.

The shape of the holding pins 30 is selected in such a way that a positive-fit engagement in the associated receiving spaces 40 on the spring element 25 is ensured, so that the holding pins are supported on the bearing element 20 without tilting, and the top pin does not block the deflection of the spring element.

Figure 10:
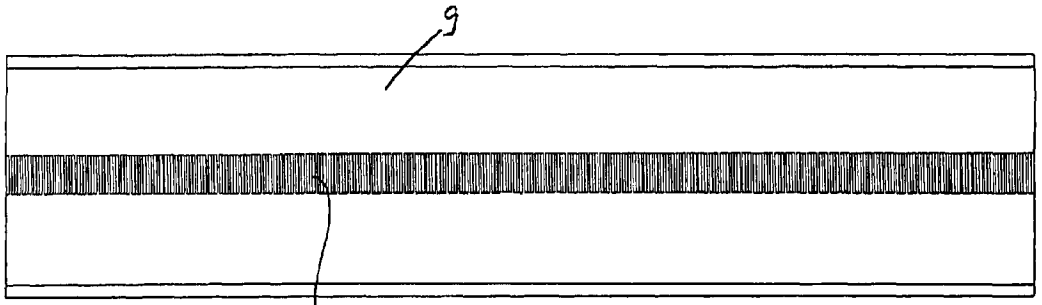
FIG. 10: shows an end-face view of an embodiment of a longitudinal beam which is modified with respect to FIG. 9.
Figure 11:
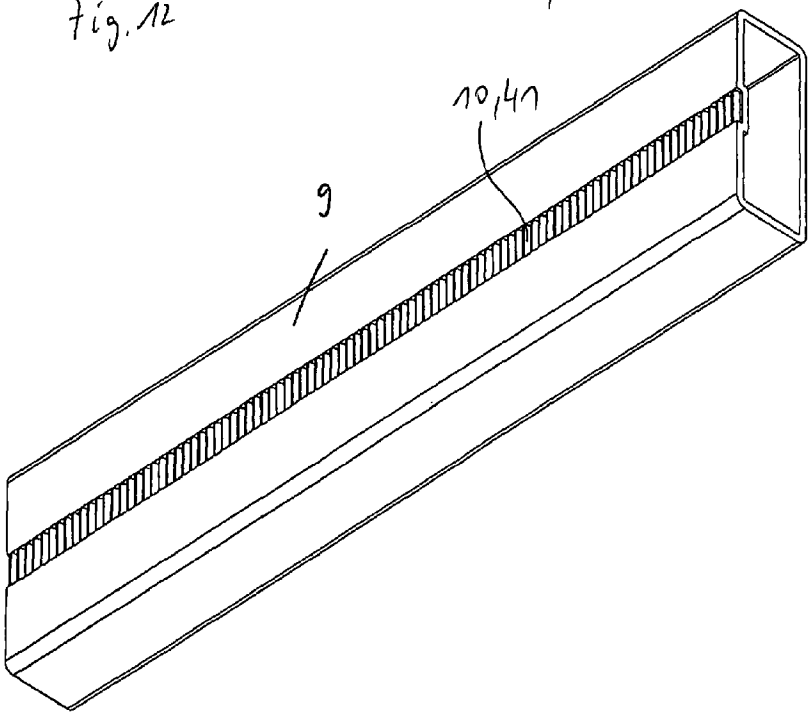
FIG. 11: shows the perspective illustration according to FIG. 10.
Figure 12:
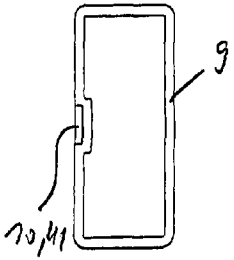
FIG. 12: shows the section through the arrangement according to FIG. 10.

As a modification of the fastening of a separate locking rail 10 in an undercut receiving profile 22 of a longitudinal beam 9, FIGS. 10 to 12 now show that an embossed profile 41 as a tooth profile may be impressed in the metal profile of the longitudinal beam 9. The same features as for the locking rail 10 described above are thus achieved.

Figure 13:
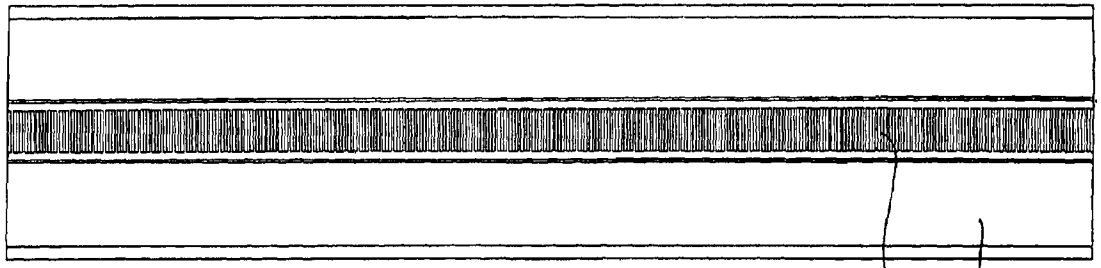
FIGS. 13 to 15: show an embodiment of the longitudinal beam which is modified with respect to FIGS. 10 to 12.
Figure 14:
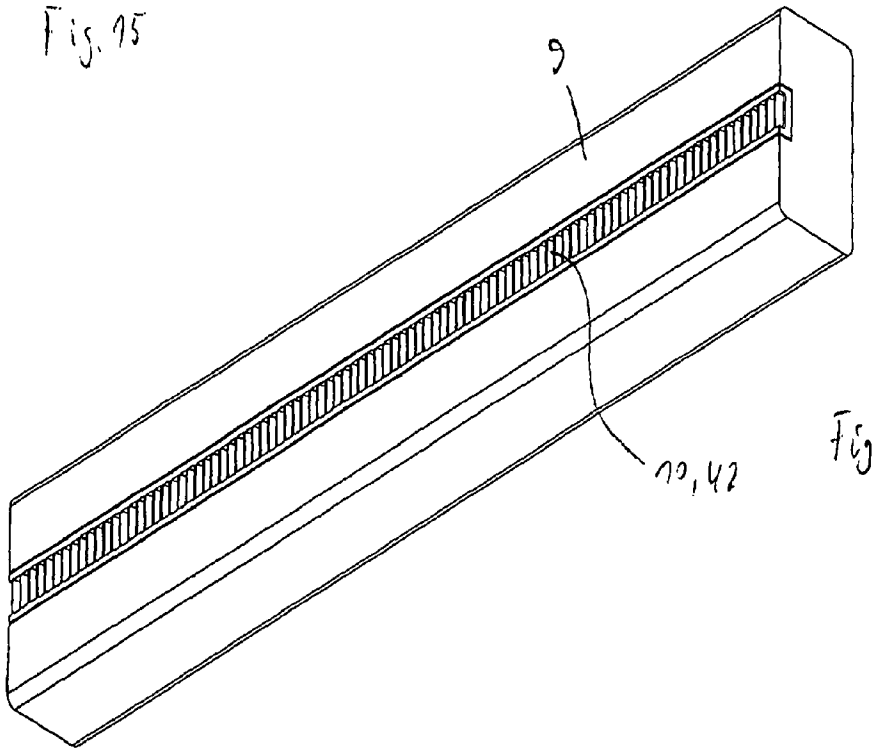
Figure 15:
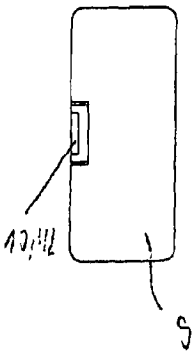

As a further embodiment, FIGS. 13 to 15 show an insertion profile 42 in a longitudinal profile in the area of the longitudinal beam; the insertion profile may also be separately inserted and fastened as a tooth profile.

Figure 16:
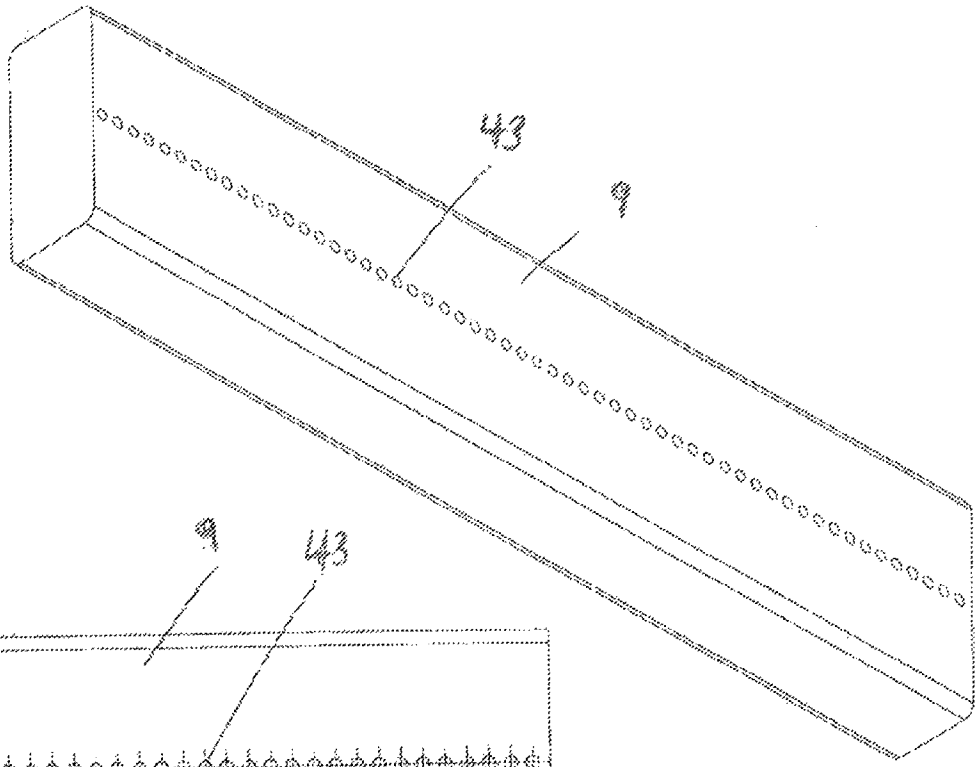
FIGS. 16 and 17: show a further embodiment.
Figure 17:
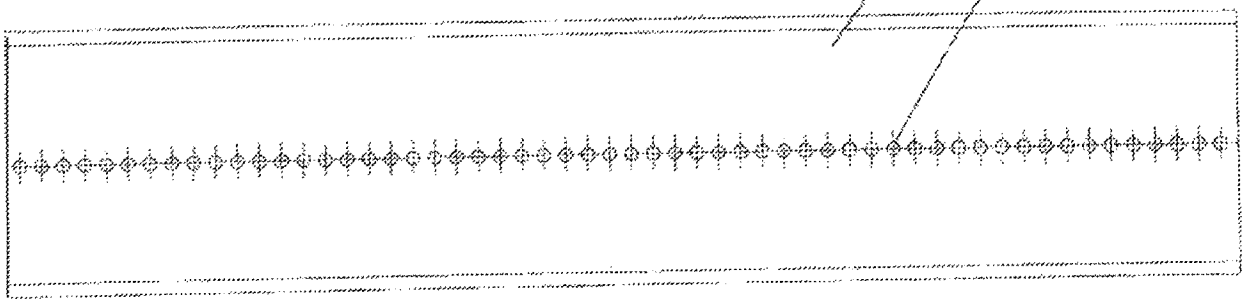

FIGS. 16 and 17 show that a perforated profile 43 may also be incorporated directly into the material of the longitudinal beam 9 on the inner side of the longitudinal beam 9, while FIGS. 18 and 19 show that such a perforated profile 43 may also be inserted and fastened in a separate groove as an insertion profile 42.

Figures 20, 21, 22:
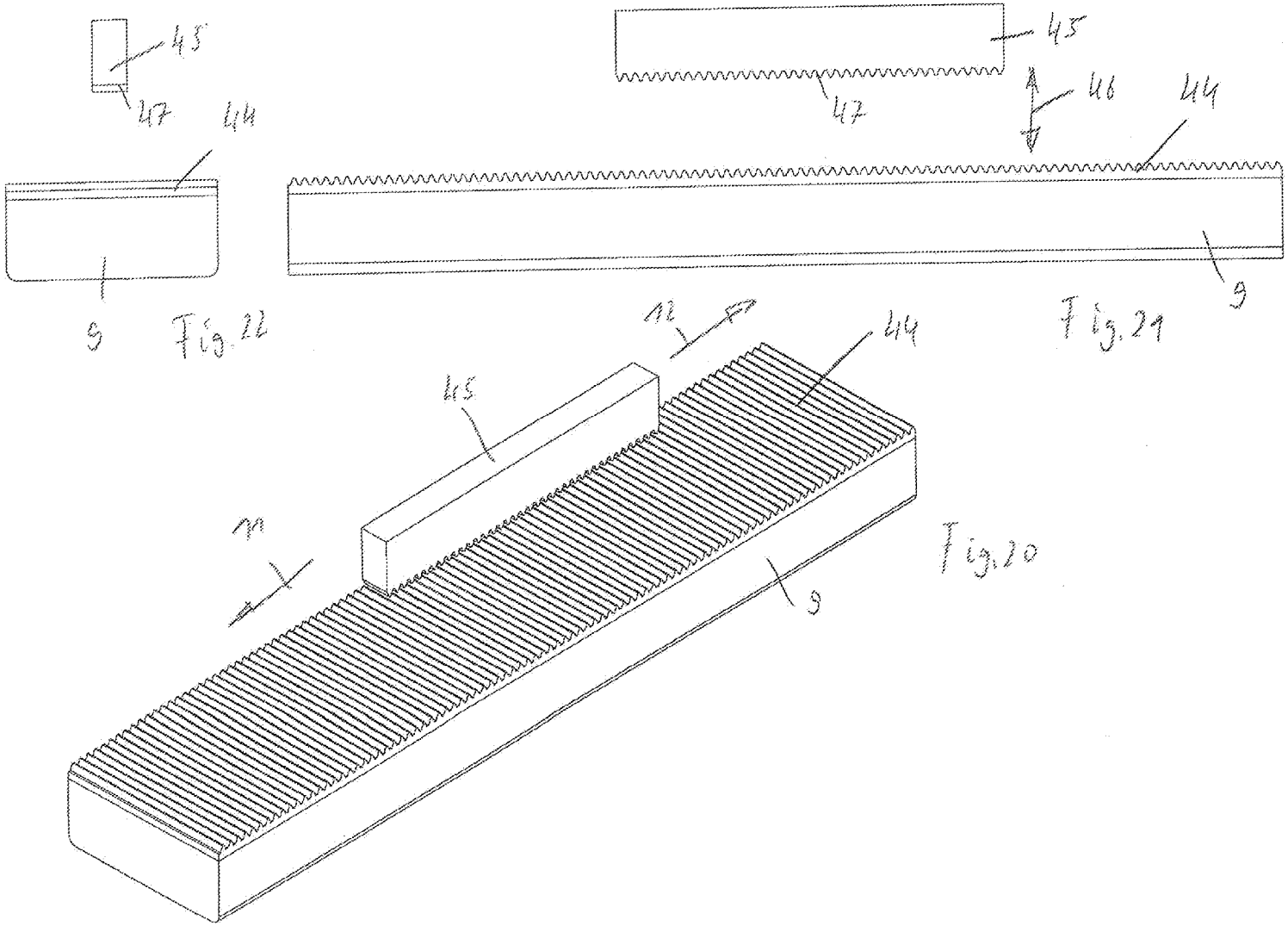
FIGS. 20 to 22: show a modified embodiment of a locking element in the bearing element.

FIGS. 20 to 22 show an embodiment which is modified with respect to the previously described locking bars 32, in which the locking bars 32 are replaced by a locking comb 45 which cooperates with an associated toothed flat profile 44.

If the locking comb 45 is lifted out of the toothing of the flat profile 44 in the arrow direction 46, the entire bearing element, which is connected to the locking comb 45, may then be moved along the longitudinal beam 9 in the arrow directions 11, 12. However, if the locking comb with its toothing 47 is brought into engagement with the toothing of the flat profile 44 in the arrow direction 46, locking in the arrow directions 11, 12 is then provided.

Figures 23, 24:
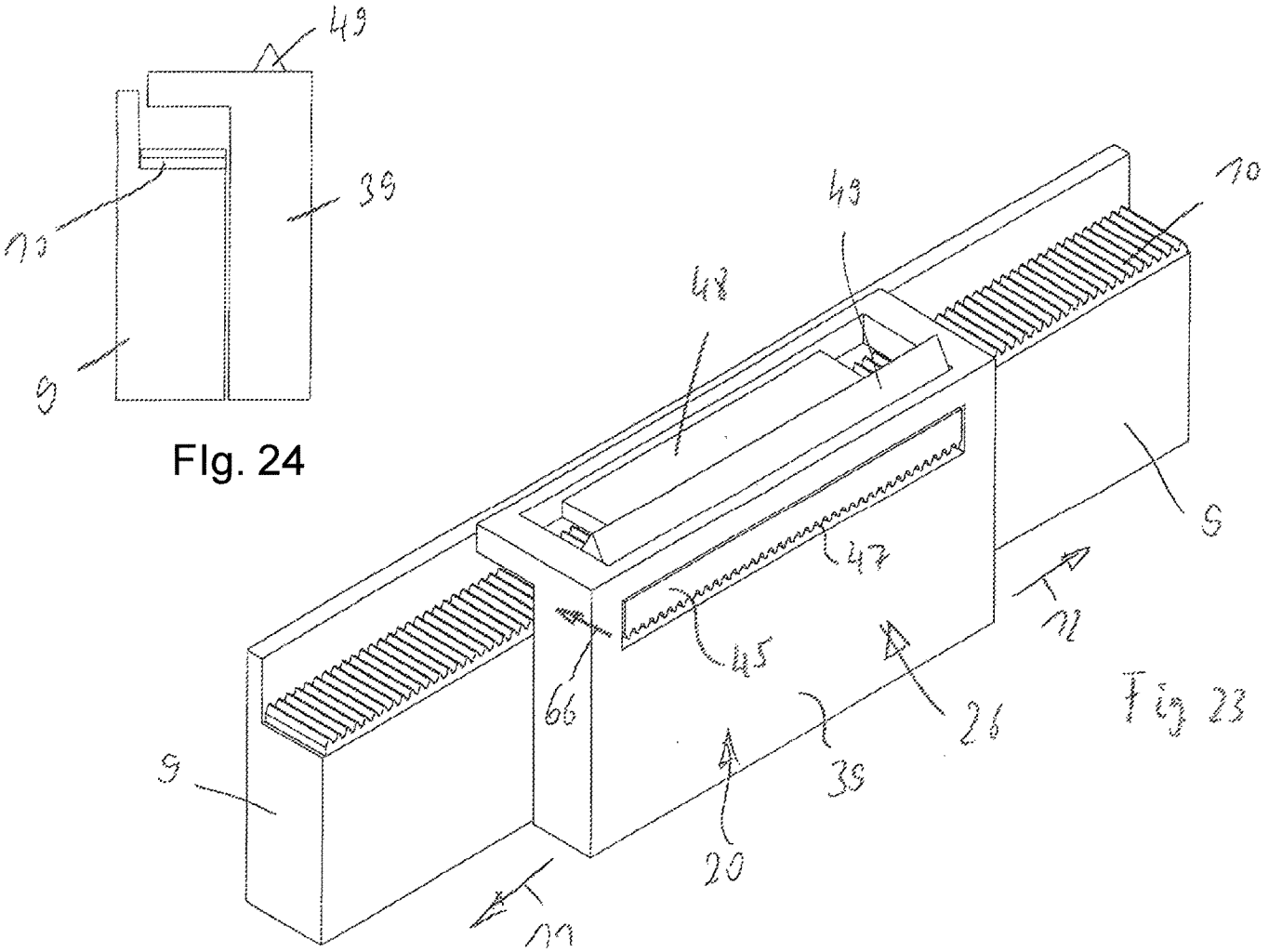
FIGS. 23 and 24: show an embodiment which is modified with respect to the preceding design.

FIGS. 23 and 24 show another modified embodiment in which it is apparent that a locking comb 45 may be brought into engagement with the tooth profile of the locking rail 10 in the horizontal direction. For this purpose, an activating strip 49 is provided, which behind a cover 48 actuates the locking comb 45 in such a way that it may be selectively engaged with the tooth profile of the locking rail 10 in the arrow direction 66, or may be selectively disengaged in the direction opposite from the illustrated arrow direction 66. Here as well, the bearing element 20 in its design as a locking plate is movable and fixable with its housing 39 in the arrow directions 11, 12.

Figures 25, 26, 27:
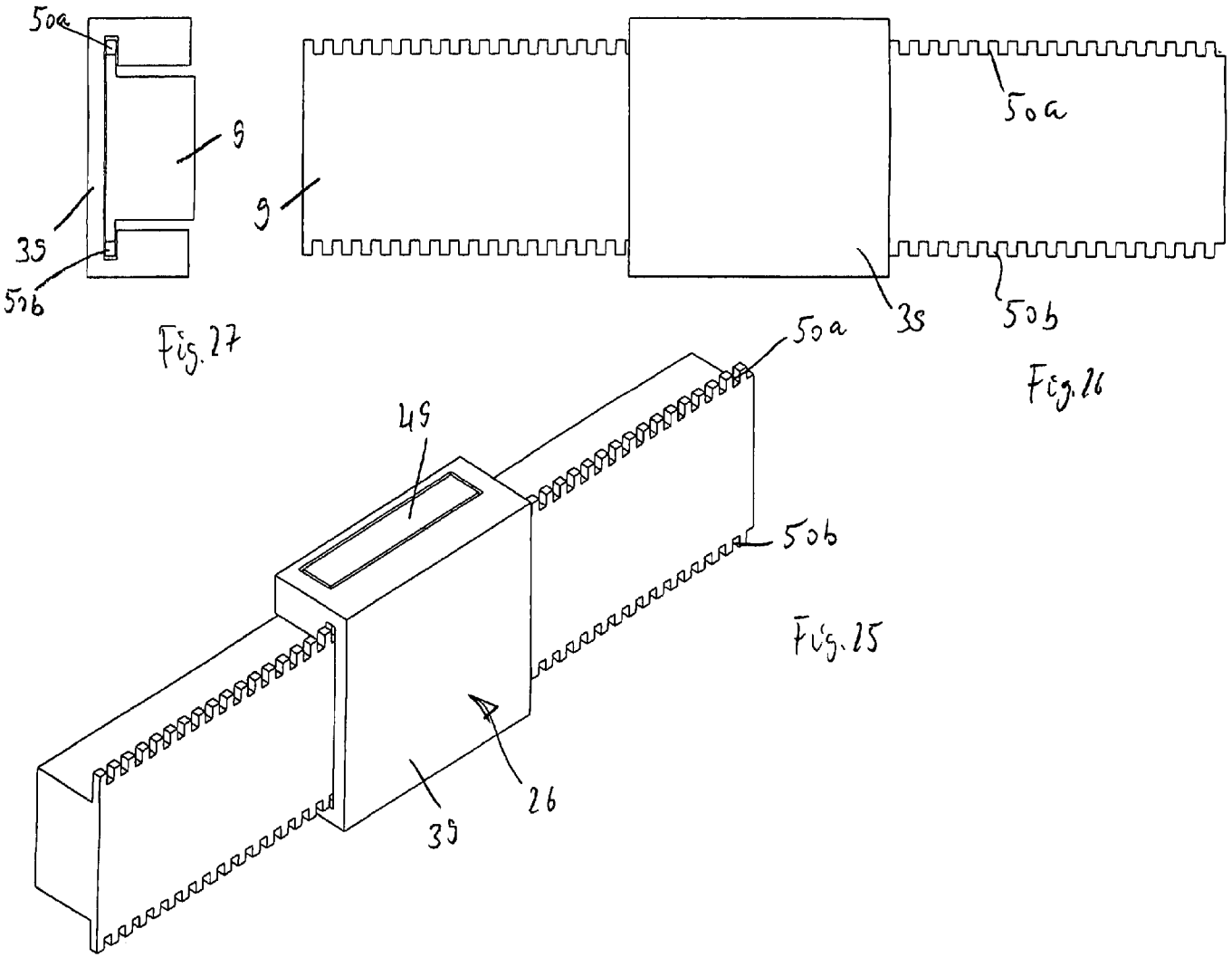
FIGS. 25 to 27: show a further embodiment of the design of the bearing element.

FIGS. 25 to 27 show a modified embodiment thereof, in which it is apparent that a locking rail may have tooth rows 50*a*, 50*b* at the top and bottom, and an associated activating strip 49 is assigned to each tooth row and may be selectively brought into a position with spring-loaded engagement with the tooth row 50*a*, 50*b*, or, against the spring load, into a position with disengagement from the tooth row 50*a*, 50*b*.

Figure 29:
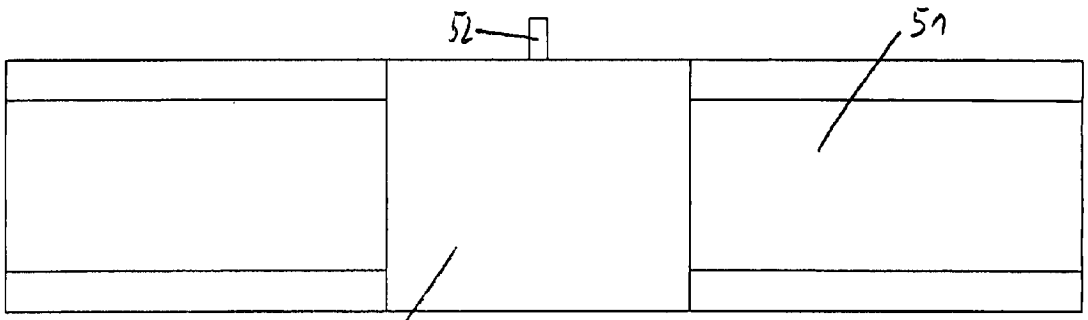
FIGS. 28 to 30: show a further embodiment of the design of the bearing element.
Figure 28:
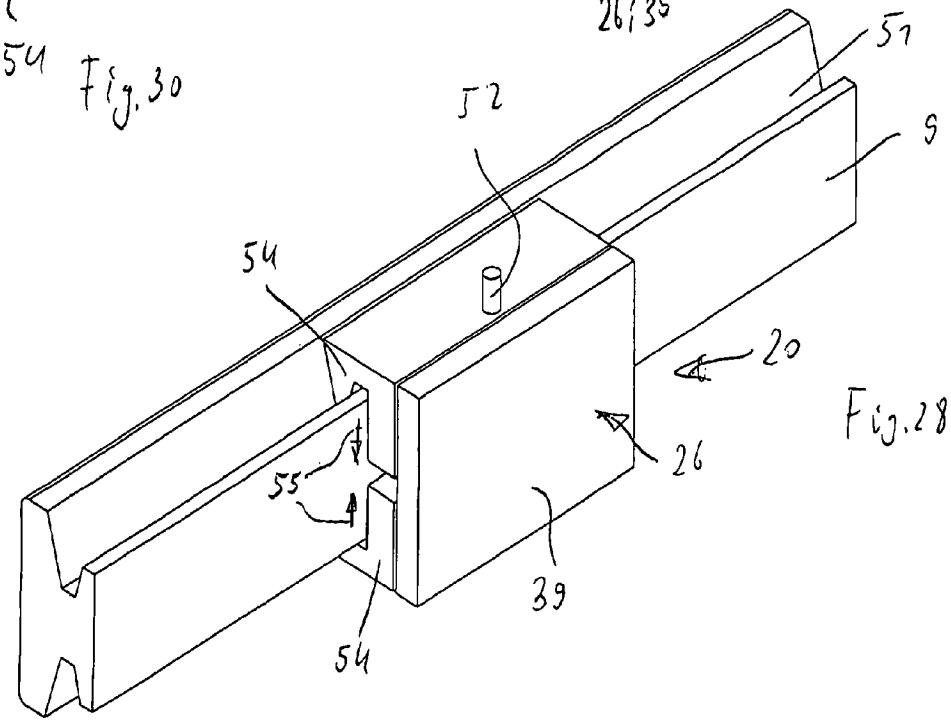
Figure 30:
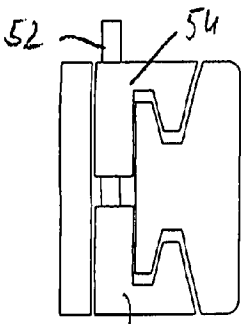

A modified embodiment is once again illustrated in FIGS. 28 to 30, where a clamping engagement is shown instead of a toothed engagement.

The locking plate 26 of the bearing element 20 in these figures is made up of two oppositely facing clamping jaws 54, each of which is movable and fixable on a longitudinal beam, the longitudinal beam being designed as a prismatic guide 51.

The clamping may be selectively established or discontinued using an actuator button 52. The actuator button may act on the clamping jaws 54 in a spring-loaded manner, but may also be designed as a screw spindle or the like.

It is also possible to use an eccentric clamp button instead of a screwable or pressable actuator button 52.

Figure 32:
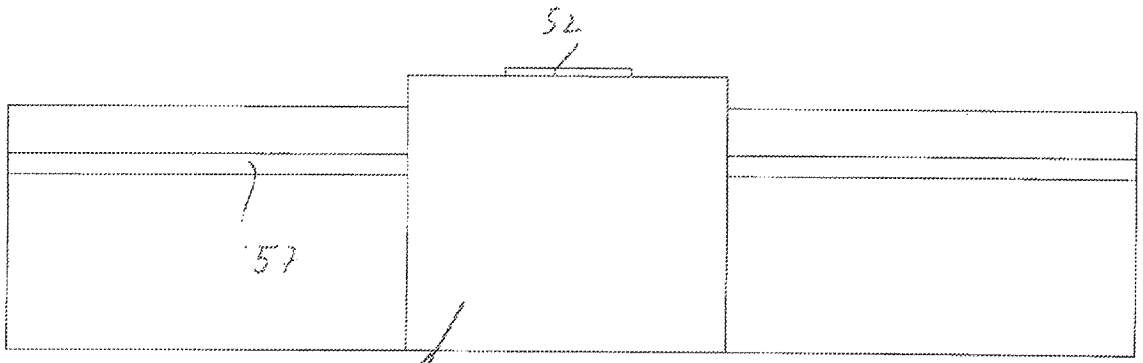
FIGS. 31 to 33: show a further embodiment of the design of the bearing element.
Figure 33:
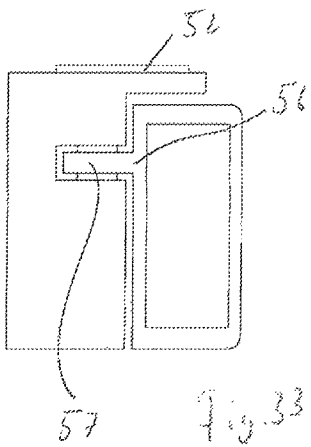
Figure 31:
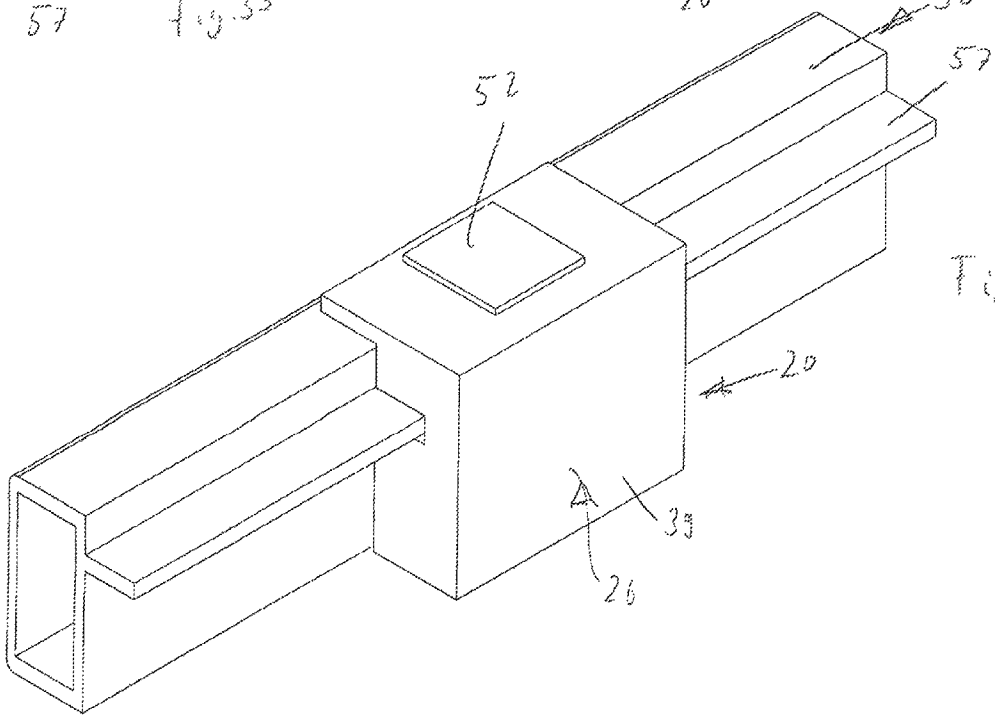

As a further exemplary embodiment, FIGS. 31 to 33 show the design of the longitudinal beam 9 as a polygonal profile 56, the clamping of the bearing element 20 taking place on a profile leg 57, and the clamping being carried out using an actuator button 52 which has a design that is either spring-loaded or mechanically pressable against the profile leg 57.

Figures 34, 35, 36:
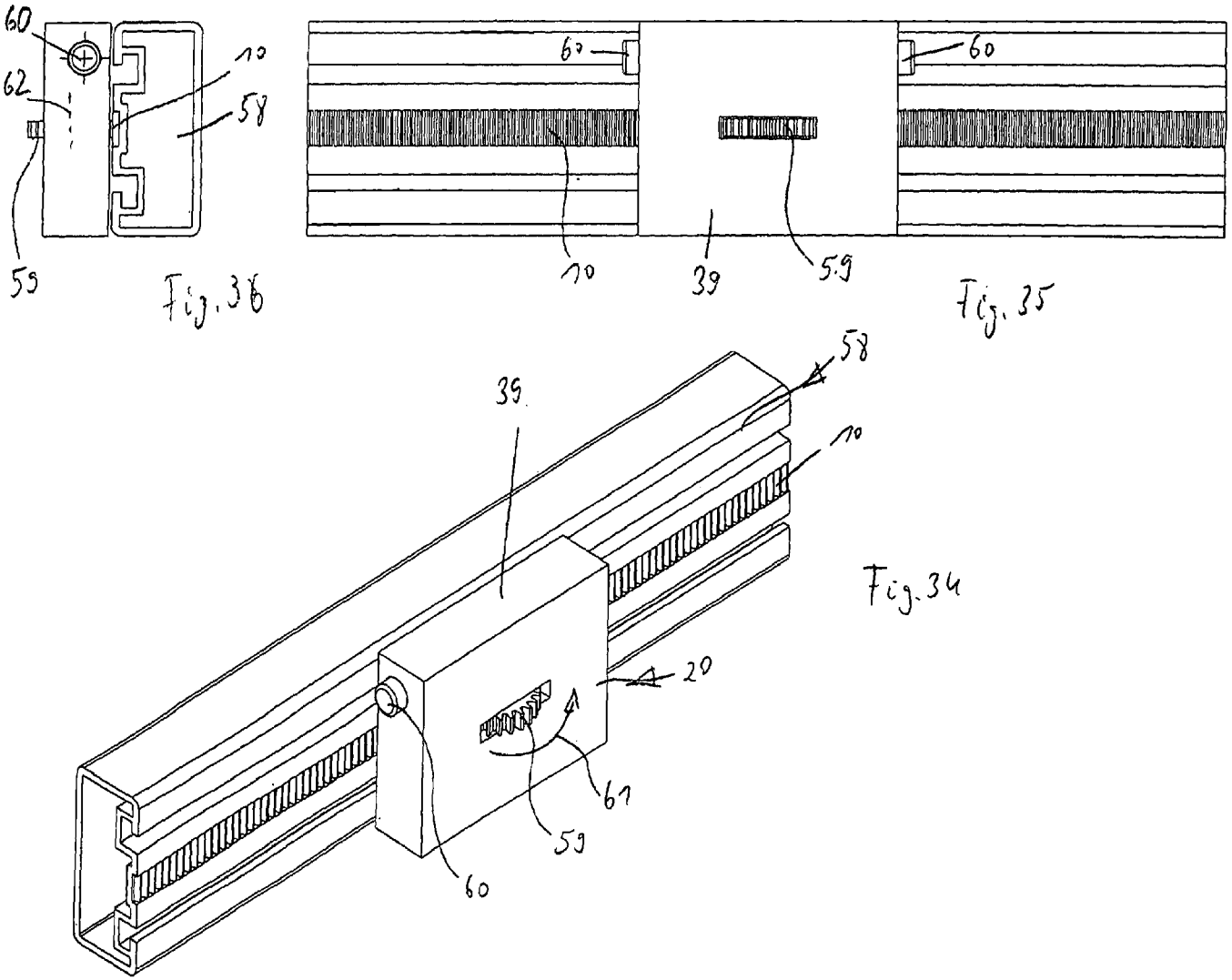
FIGS. 34 to 36: show a further embodiment of the design of the bearing element.

FIGS. 34 to 36 show a polygonal profile 58 which has a locking rail 10 of the type of the previously described design, the bearing element 20 together with its housing 39 having a rotatably supported gearwheel 59 which is in toothed engagement with the locking rail 10. The rotation of the gearwheel 59 in the arrow direction 61 and in the opposite direction thereto may be locked by an activation button 60, so that in any arbitrary displacement position, the bearing element 20 may be moved along the longitudinal beam 9 in the arrow directions 11, 12 when the activation button 60 is actuated.

The actuation of the activation button 60 may be provided either in a spring-loaded manner, or mechanically as a screw spindle or clamping element.

The rotation of the gearwheel 59 takes place in the rotational axis 62 according to FIG. 36, which is merely indicated.

It is also apparent from FIG. 4 that a scaling 63 may be applied to the bearing element 20, which may be matched with a scaling, not illustrated in greater detail, on the side of the longitudinal beam 9. In this way, the left and the right sides of associated bearing elements 20 may always be anchored to the longitudinal beam 9 at the same location.

LIST OF REFERENCE NUMERALS

1 Lying surface
2 Bed frame
3 Slatted frame
4 Flexible slat
5 Flexible slat
6 Flexible slat
7 Flexible slat
8 Transverse beam
9 Longitudinal beam
10 Locking rail
11 Arrow direction
12 Arrow direction
13 Person
14 Head area
15 Shoulder area
16 Lumbar area
17 Foot area
18 Spacing (horizontal)
19 Height adjustment
20 Bearing element
21 Hollow profile (of 3)
22 Receiving profile
23 Detent hook (clip lock)
24 Clip lock
25 Spring element
26 Locking plate (horizontal displacement)
27 Spring body
28 Height adjustment plate (vertical displacement)
29 Locking part (for 28)
30 Holding pin
31 Spacer (of 26)
32 Locking bar
33 Arrow direction
34 Handle
35 Shaft
36 Bearing journal
37 Receptacle
38 Compression spring
39 Housing (of 26)
40 Receiving space (for 30)
41 Embossed profile
42 Insertion profile
43 Perforated profile
44 Flat profile
45 Locking comb
46 Arrow directions
47 Toothing (of 45)
48 Cover
49 Activating strip
50 Tooth row a, b
51 Prismatic guide
52 Actuator button
53 Clamping device
54 Clamping jaw
55 Arrow direction
56 Polygonal profile
57 Profile leg
58 Polygonal profile
59 Gearwheel
60 Activation button
61 Arrow direction
62 Rotational axis
63 Scaling
64 Arrow direction
65 Insertion guide
66 Arrow direction

The invention claimed is:

1. A bed frame having flexible slats which are adjustable in a horizontal plane and having at least one bearing element for supporting one end of at least one flexible slat on a longitudinal beam of the bed frame, wherein the at least one bearing element is movable over an arbitrary displacement path along the longitudinal beam, the at least one bearing element comprising a housing which accommodates the respective end of the at least one flexible slat and at least one spring-loaded detent device situated in the housing, the at least one spring-loaded detent device being actuatable by hand, and engaging with associated receiving profiles in the longitudinal direction of the longitudinal beam and lockable at that location, wherein the receiving profiles are designed as locking rails which extend in the longitudinal direction over an entire length of the longitudinal beam and bears associated teeth, and wherein the detent device comprises at least two locking bars which face in opposite directions and are in spring-loaded engagement with the associated toothing of the locking rail.

2. The bed frame according to claim 1, further comprising a handle to provide disengagement so as to bring the at least two locking bars out of the spring-loaded engagement with the locking rail.

3. The bed frame according to claim 2, wherein the locking bar is connected to the handle in a rotationally fixed manner via a shaft.

4. The bed frame according to claim 1, wherein the at least one bearing element is held by at least one detent hook which engages behind an undercut of the receiving profile.

5. The bed frame according to claim 1, wherein the receiving profile is designed as a perforated rail which extends in the longitudinal direction over the length of the longitudinal beam, and which has an associated perforated profile.

6. The bed frame according to claim 1, wherein the receiving profile is designed as an embossed profile which extends in the longitudinal direction over the longitudinal beam and which is impressed in the metal profile of the longitudinal beam.

7. The bed frame according to claim 1, wherein the detent device is a locking comb which bears a plurality of detent elements which may be brought into engagement with a flat profile in the longitudinal direction of the longitudinal beam.

8. The bed frame according to claim 1, further comprising additional bearing elements which are used for accommodating additional flexible slats may be clipped vertically into the receiving profile of the longitudinal beam.

9. A method for assembling the bed frame according to claim 1, comprising defining different lying areas on the bed frame by inserting flexible slats having different spacings from one another into the bed frame, in order to ensure maximum support of a person at a desired body support point of the person, with a high density of the flexible slats.

10. A bed frame comprising:

spring slats configured to be adjustable in a horizontal plane, at least one mounting element for mounting one end of the at least one of the spring slats on a longitudinal member of the bed frame, the at least one mounting element configured to be displaceable along the longitudinal member over any desired displacement length, the at least one mounting element comprising a housing to receive a respective end of the spring slats and at least one manually operated spring-loaded locking device that engages in associated receiving profiles in a longitudinal direction of the longitudinal member and is configured to be locked therein, a locking rail forming the receiving profile that extends in the longitudinal direction over an entire length of the longitudinal member and carries an associated set of teeth, the locking device comprising at least two locking latches oriented in opposite directions to one another and engaged with the associated set of teeth under spring load.

11. The bed frame according to claim 10, further comprising a handle to unlock the at least two locking latches and bring them out of spring-loaded engagement with the locking rail.

12. The bed frame according to claim 11, wherein the at least two locking latches are connected with the handle by a shaft so that the handle cannot turn.

13. The bed frame according to claim 10, wherein the at least one mounting element is held by at least one locking hook which engages behind an undercut of the receiving profile.

14. The bed frame according to claim 10, wherein the receiving profile is embodied in the form of a perforated rail which extends in the longitudinal direction over the length of the longitudinal member and has an associated perforated profile.

15. The bed frame according to claim 10, wherein the receiving profile is embodied in the form of a stamped profile which is stamped in a metal profile of the longitudinal member and extends in the longitudinal direction over the longitudinal member.

16. The bed frame according to claim 10, wherein the locking device is a locking comb which carries a multiplicity of locking elements which can be brought into engagement with a flat profile in the longitudinal direction of the longitudinal member.

17. The bed frame according to claim 10, further comprising additional mounting elements which serve for reception of additional spring slats, can be clipped vertically into the receiving profile of the longitudinal member.

18. The bed frame according to claim 10, wherein with the aid of mutually differently spaced spring slats different lying areas can be defined on the bed frame to guarantee maximum support of a person at desired body contact points of the person with a high density of spring slats.

* * * * *